US007934608B2

(12) United States Patent
Ydstrom

(10) Patent No.: US 7,934,608 B2
(45) Date of Patent: May 3, 2011

(54) RACK FOR TRANSPORT AND STORAGE

(75) Inventor: Per Ydstrom, Perstorp (SE)

(73) Assignee: Schoeller Arca Systems AB, Perstop (SE)

( * ) Notice: Subject to any disclaimer, the term of this patent is extended or adjusted under 35 U.S.C. 154(b) by 0 days.

(21) Appl. No.: 12/521,937

(22) PCT Filed: Dec. 20, 2007

(86) PCT No.: PCT/SE2007/001132

§ 371 (c)(1), (2), (4) Date: Aug. 3, 2009

(87) PCT Pub. No.: WO2008/082340

PCT Pub. Date: Jul. 10, 2008

(65) Prior Publication Data

US 2010/0038331 A1 Feb. 18, 2010

(30) Foreign Application Priority Data

Jan. 3, 2007 (SE) ..... 0700004

(51) Int. Cl.
*A47G 19/08* (2006.01)

(52) U.S. Cl. ..... 211/41.17; 211/195

(58) Field of Classification Search ..... 211/195, 211/194, 182, 41.17, 41.18; 206/706–708, 206/711; 312/223.2, 110, 331; 361/747, 361/748, 752, 754, 759

See application file for complete search history.

(56) References Cited

U.S. PATENT DOCUMENTS

| | | | | |
|---|---|---|---|---|
| 2,917,179 | A * | 12/1959 | Casey et al. | 211/40 |
| 3,014,594 | A * | 12/1961 | Kerstner | 211/41.17 |
| 3,877,134 | A * | 4/1975 | Shanahan | 29/417 |
| 4,045,104 | A * | 8/1977 | Peterson | 312/265.4 |
| 4,600,231 | A * | 7/1986 | Sickles | 294/161 |
| 5,114,018 | A * | 5/1992 | Bischoff et al. | 211/41.18 |
| 6,223,917 | B1 * | 5/2001 | Bruder | 211/189 |
| 6,385,050 | B1 | 5/2002 | Orita et al. | |
| 2002/0184831 | A1 | 12/2002 | Matsuda et al. | |
| 2007/0279474 | A1 | 12/2007 | Sato | |

FOREIGN PATENT DOCUMENTS

WO 2006 075653 7/2006

* cited by examiner

*Primary Examiner* — Korie Chan

(74) *Attorney, Agent, or Firm* — Oblon, Spivak, McClelland, Maier & Neustadt, L.L.P.

(57) ABSTRACT

A collapsible rack for transport and storage, includes a first and a second panel and a plurality of distance bars. The first and second panel include a groove side including at least one groove. A first and a second edge is arranged on opposite sides and adjacent to these, a third and a fourth edge. The third and fourth edges each include at least one hole that extends parallel to the first and second edges. The hole has a non-circular shape. The distance bars at each of their ends includes a hole coupling mechanism. The hole coupling mechanism extends perpendicular to the extension of the bar. The hole coupling mechanisms include clutching sections that match the hole, wherein pivoting between the bars and the first and second panel is prevented where the hole coupling mechanism and hole are fully mated.

19 Claims, 3 Drawing Sheets

RACK FOR TRANSPORT AND STORAGE

BACKGROUND OF THE INVENTION

1. Field of the Invention

Figure 1:
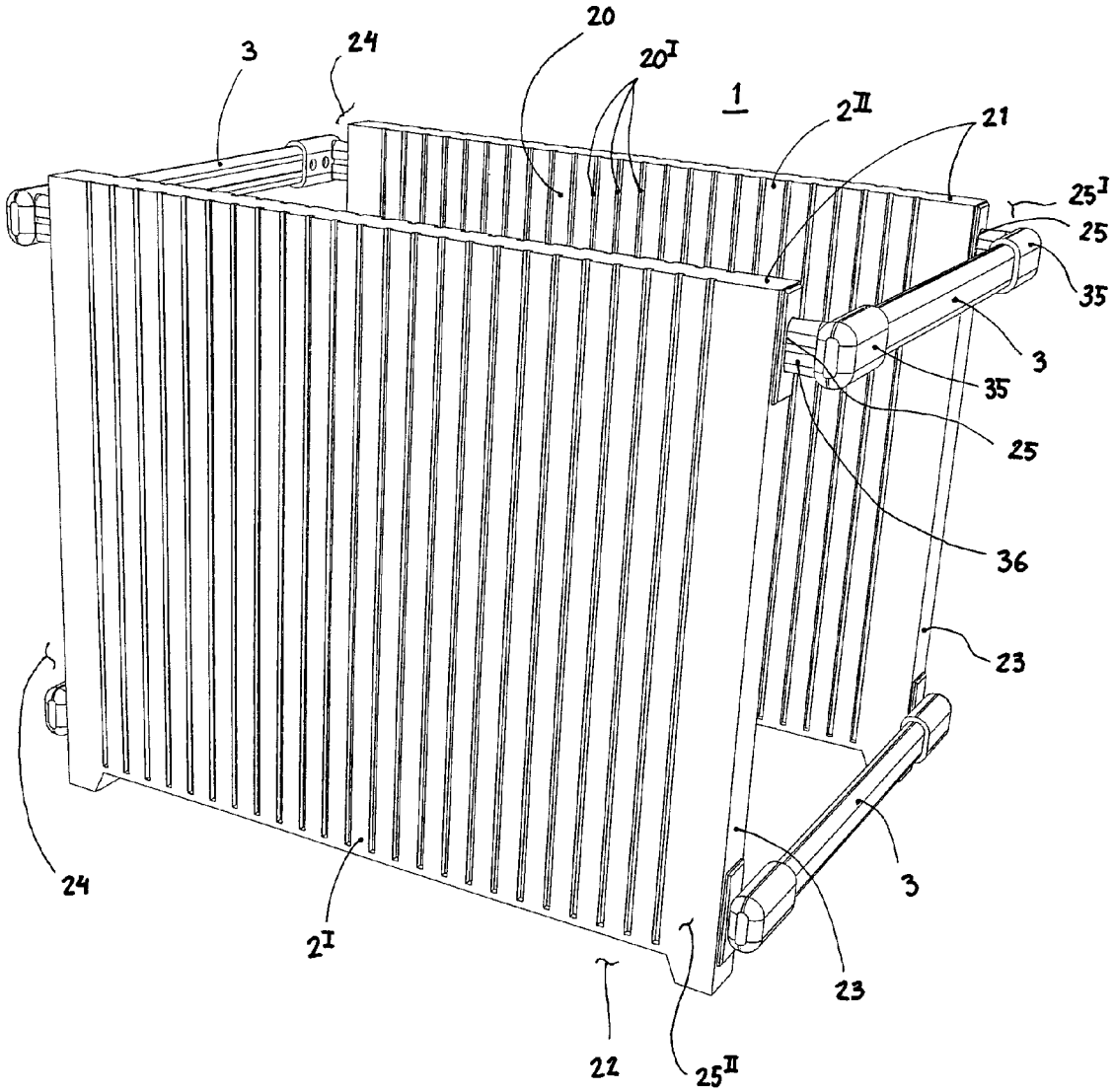

The present invention relates to a collapsible rack for transport and storage of flat or semi flat objects.

2. Description of Related Prior Art

Racks for keeping flat objects organized and protected during transport and storage is a well known item. These racks are known from a number of different technical fields. We may here mention electronic industry where printed circuit boards with components installed often are stored and transported this way, both during assembly in so called surface mounting lines and for delivery of fully assembled and semi-assembled boards. Racks are also used during curing and similar treatment of the printed circuit board prior to installation of components. One such rack is known from U.S. Pat. No. 4,761,044 showing a rack which have an adjustable width. This will make it possible to adjust the rack for the specific printed circuit board currently in use. Another rack is known from U.S. Pat. No. 5,593,046. This rack is foldable but have a great number of hinges which will make it very difficult to ensure parallelity between the panels carrying the printed circuit boards. It will furthermore be very difficult to ensure that the panels and the arms connecting them relate to one another perpendicular as seen from above. The design is also rather complicated and therefore costly. Since each arm is provided with no less than three hinges, it will become impracticable to obtain any acceptable tolerance.

It is also known to use racks in food industry as for example in bakeries and for trays in restaurants.

In very many cases these racks will have to be transported without carrying any content. It is therefore be beneficial if it was possible to reduce the size of such an empty rack in some way in order to minimize the transport cost. It is of course possible to disassemble a rack and to assemble it again after transport. However, this would require special skill and training of the personnel as well as an increased wear and tear of the different parts would occur. There is also a risk of loosing parts and tolerances in an assembled rack would inevitably be hampered. It is in many cases important to uphold narrow tolerances as well as stability since especially electronic components can be rather valuable as well as sensitive.

SUMMARY OF THE INVENTION

The present invention aims at solving the above problems by providing a collapsible rack which minimizes the number of moveable parts and ensures a stable carrier for sensitive components. It has through the present invention been made possible to solve the above problems and a collapsible, sturdy and cost effective rack has been brought about.

Accordingly, the present invention relates to a collapsible rack for transport and storage. The collapsible rack is provided with a first and a second panel and a plurality of distance bars. The first and second panel have a groove side provided with at least one groove, a first and a second edge arranged on opposite sides and adjacent to these, a third and a fourth edge. The invention is characterized in that the third and fourth edges are provided with each at least one hole which extends parallel to the first and second edges. This hole have a non-circular shape. The distance bars are at each of its ends provided with a hole coupling means. The hole coupling means extends perpendicular to the extension of the bar and the hole coupling means are provided with clutching sections which matches the hole. Pivoting between the bars and the first and second panel is prevented through the non-circular shape of the hole when the matching hole coupling means and hole is fully mated. The non-circular shaped hole is then so shaped that the clutching section is prevented from rotating around its axis of extension when in a clutched position. Accordingly, the non-circular shaped hole have a hole wall surface with a non-constant radius. It is possible to provide the non-circular shaped hole with a number of different shapes of which we may mention; triangular, oblong, quadratic, rectangular, pentagonal, hexagonal, star-shaped, provided with splines, provided with ribs, provided with satellites and a combination thereof. Most shapes are self explanatory but a few will need some clarification. A hole provided with ribs may actually have a mainly circular shape but is provided with one or more axial ribs, and as defined the clutching section is so shaped that it match this hole shape. A hole with satellites can also be circular and is provided with one or more further holes outside this main hole. Needless to say, the clutching section is then shaped to match this design.

The coupling means are preferably provided with a pivoting section arranged on the end of clutching section. The coupling means are preferably also provided with a spring which have the purpose of pulling the clutching section into interaction with the hole. The operator will then only have to pull the two distance bars apart to fold an emptied rack. It is of course advantageous to provide the coupling means with a stopper which limits the distance it can be pulled out.

The distance bar preferably comprises a bar section and two end sections. The bar section slides into a bar hole on each of the end sections. This allows the rack to easily be designed for the desired printed circuit board width by only changing the bar section. The end sections are suitably provided with a locking hole and a lock screw arranged perpendicular to the bar section. This allows the width of the rack to be locked after having been adjusted to exact width. The screw may have a conical tip which is pressed into the face of the bar section. The threads in the locking hole are suitably tight enough to prevent the screw from getting loose. It also possible to lock the screw with cyanoacrylate glue or the like. It is finally suitable to use a cap to cover the open end of the locking hole to prevent unauthorized tampering with the locking screw. This cap may even be molded together with, and attached to, the end section via a so-called live hinge The clutching sections are preferably tapered and the hole is also tapered to match the clutching section. This will minimize any play in the rack which otherwise would be wobbly. Wear and tear will not have effect on such a design and the stability will be kept within the desired range for a very long time. The taper is suitably larger than 1° as seen from the insertion axis. Accordingly, both the hole and the clutching section have a conical shape and the angle of the side faces are adapted so that the parts do not wedge hard enough to cause problems. The angle should be adapted to the material selected, but normally an angle above 2-4° should be without problems.

The first and second panels are suitably provided with a channel which runs between the third and fourth edges as well as parallel to the first and second edges and ends with the holes on said third and fourth edges. This channel is then suitably arranged adjacent to the first edge. This cannel may suitably be so designed that an end plug containing the hole intended to match the clutching section is inserted in the end of the channel. It will hereby be a rather simple task to insert a spring between the two opposite clutching sections, pulling the two together. It is also rather easy to insert a stopper in the form of a washer or a pin on the inside of the end plug which, as desired, limits the outward movement of the clutching section.

According to a preferred embodiment of the invention a second channel is arranged adjacent to the second edge. This second channel is then arranged parallel to the second edge. The second channel suitably ends with a guiding hole. This hole may be fully circular, in fact it is advantageous to design it this way since it then will not have to be manipulated during folding. Accordingly, the locking in erect position will be taken care of by the clutching section and hole described above. The guiding hole is then intended to receive couplers of secondary distance bars. The couplers are suitably provided with a spring which have the purpose of pulling the couplers into interaction with the guiding hole. The secondary distance bar preferably comprises a bar section and two end sections wherein the bar section slides into a bar hole on each of the end sections. The end sections are suitably provided with a locking hole and a lock screw arranged perpendicular to the bar section. The couplers are, like for the clutching section described above and of the same reason, tapered and the guiding hole is also tapered to match the couplers. The taper is also here larger than 1° as seen from the insertion axis and is subject of the same considerations as discussed over the clutching section above.

The collapsible rack is suitably, in the main, manufactured of a polymeric material selected from the group consisting of; polyethylene, polypropylene, polybutene, polyvinylchloride, polyalkylenetherephtalate, acrylonitrilebutadienestyrene-copolymer, polyamide, polycarbonate, polyethersulphone and combinations thereof, through injection molding, vacuum molding, blow molding, extrusion and combinations thereof. The polymeric material may further contains a filler selected from the group consisting of, carbon black, fiber glass, carbon fiber, aramide fiber, steel fiber and combinations thereof. As should be understood by the above certain parts like screws, pins, washers may be manufactured of any suitable material. It is, for example advantageous to manufacture the bar section of aluminum or magnesium through means of extrusion or injection molding. It is also possible to manufacture the distance bar and secondary distance bar entirely of aluminum or magnesium through injection molding. In cases where the rack is used for transporting and/or storage of esd sensitive printed circuit boards it is advantageous to use leading materials to a level which fulfills the requirements for esd secured equipment. This is achieved by using metal components and/or polymeric components with a defined amount of filler of carbon black and/or carbon fiber.

DESCRIPTION OF AN EMBODIMENT EXAMPLE

The invention is described further in connection to enclosed figures showing different embodiments of the invention whereby, FIG. 1 shows, in perspective view, a collapsible rack 1 according to the invention.

Figure 2:
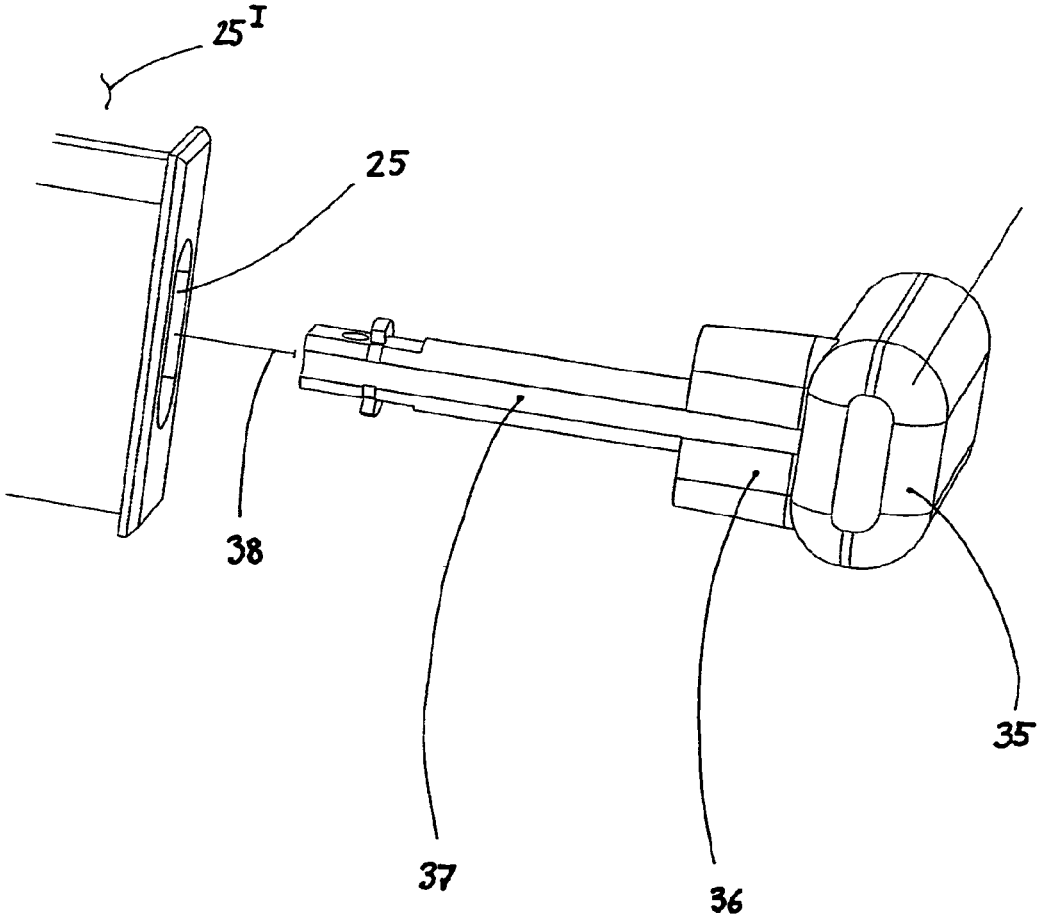

FIG. 2 shows, in perspective blown view, an upper portion of a collapsible rack 1 according to the invention where a clutching section 36 and a hole 25 is parted.

Figure 3:
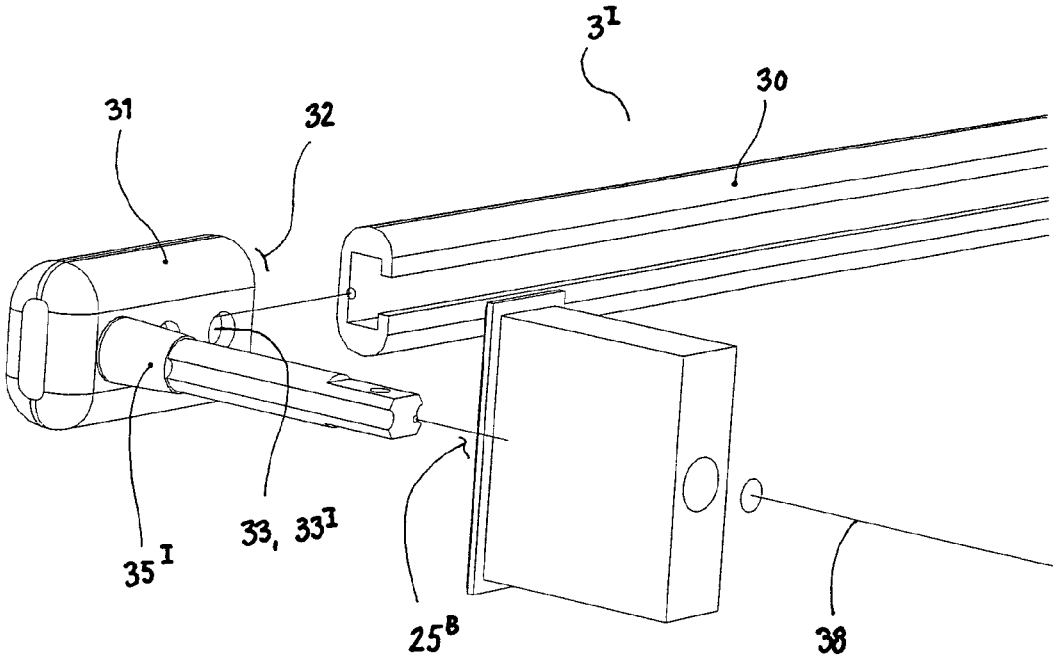

FIG. 3 shows, in perspective blown view, an lower part of a collapsible rack 1 according to the invention where a coupler $\mathbf{35}^{I}$ and a coupler hole $\mathbf{25}^{B}$ is parted.

Accordingly, FIG. 1 shows a collapsible rack 1 for transport an storage. The collapsible rack 1 is provided with a first and a second panel $\mathbf{2}^{I}$ and $\mathbf{2}^{II}$ respectively and a plurality of distance bars 3. The first and second panel $\mathbf{2}^{I}$ and $\mathbf{2}^{II}$ respectively, have a groove side 20 provided with a number of grooves $\mathbf{20}^{I}$ intended for receiving printed circuit boards. The panels $\mathbf{2}^{I}$ and $\mathbf{2}^{II}$ respectively have first and second edges 21 and 22 respectively, arranged on opposite sides and adjacent to these, third and a fourth edges 23 and 24 respectively. The first and second panels $\mathbf{2}^{I}$ and $\mathbf{2}^{II}$ respectively are provided with a channel $\mathbf{25}^{I}$ (hidden) which runs between the third and fourth edges 23 and 24 respectively as well as parallel to the first and second edges 21 an 22 respectively and ends with the holes 25 on said third and fourth edges 23 and 24 respectively. The channel 25' is arranged adjacent to the first edge 21. Accordingly, the holes 25 extends parallel to the first and second edges 21 and 22 respectively. These holes 25 have a non-circular shape. The distance bars 3 are at each of its ends provided with a hole coupling means 35. The hole coupling means 35 extends perpendicular to the extension of the bar 3. The hole coupling means are provided with clutching sections 36 which matches the hole 25 so that pivoting between the bars 3 and the first and second panel $\mathbf{2}^{I}$ and $\mathbf{2}^{II}$ respectively is prevented once the hole coupling means 35 and holes 25 are fully mated. The distance bars 3 are pulled out of engagement in FIG. 1.

Referring now to FIG. 2. The coupling means 35 are provided with a pivoting section 37 arranged on the end of clutching section 36. Accordingly, once the clutching section 36 is pulled out of engagement with the hole 25, the distance bar 3 is free to pivot. The coupling means 35 are provided with a spring 38 which have the purpose of pulling the clutching section 36 into interaction with the hole 25. This spring 38 is hidden in the channel $\mathbf{25}^{I}$.

Referring now to FIG. 3 which shows a secondary distance bar $\mathbf{3}^{I}$. These are similar to the distance bars 3 in that they comprises a bar section 30 and two end sections 31. The bar section 30 slides into a bar hole 32 on each of the end sections 31. The end sections 31 are provided with a locking hole 33 and a lock screw $\mathbf{33}^{I}$ arranged perpendicular to the bar section 30.

Referring again to FIG. 2 showing the clutching sections 36 which are tapered and the hole 25 is also tapered to match the clutching section 36. The taper is 4° as seen from the insertion axis.

As best viewed in FIG. 1, a second channel $\mathbf{25}^{II}$ (hidden) is arranged adjacent to the second edge 22. The second channel $\mathbf{25}^{II}$ is arranged parallel to the second edge 22. As can be seen in FIG. 3 the second channel $\mathbf{25}^{II}$ ends with a guiding hole $\mathbf{25}^{B}$. The guiding hole $\mathbf{25}^{B}$ is intended to receive couplers $\mathbf{35}^{I}$ of secondary distance bars $\mathbf{3}^{I}$. The couplers $\mathbf{35}^{I}$ are provided with a spring 38 which have the purpose of pulling the couplers $\mathbf{35}^{I}$ into interaction with the guiding hole $\mathbf{25}^{B}$. This spring 38 is hidden in the channel $\mathbf{25}^{II}$. Like the distance bars 3, the secondary distance bar $\mathbf{3}^{I}$ comprises a bar section 30 and two end sections 31. The bar section 30 slides into a bar hole 32 on each of the end sections 31. The end sections 31 are provided with a locking hole 33 and a lock screw $\mathbf{33}^{I}$ arranged perpendicular to the bar section 30. The couplers $\mathbf{35}^{I}$ are tapered and the guiding hole $\mathbf{25}^{B}$ is also tapered to match the couplers $\mathbf{35}^{I}$. The angle is 4° as seen from the insertion axis.

Most parts of the rack 1 is manufactured of polyamide reinforced with fiber glass and filled with carbon black for conductivity. The later is used for providing protection from electrostatic discharge.

The invention is not limited by the embodiments shown since these can be varied in different ways within the scope of the invention.

The invention claimed is:

1. A collapsible rack for transport and storage, comprising: a first panel and a second panel; and a plurality of distance bars, wherein the first panel and second panel include a groove side including at least one groove, a first and a second edge arranged on opposite sides of the groove side and a third and a fourth edge adjacent to the first and second edge, wherein the third and fourth edges each include at least one hole that extends parallel to the first and second edges, the hole having a non-circular shape, wherein the distance bars at each end thereof include a hole coupling means that extends perpendicular to a length of the bar, the hole coupling means including clutching sections that match a shape of the hole, wherein pivoting between the distance bars and the first and second panel is prevented when the hole coupling means and hole are fully mated, and wherein the hole coupling means includes a pivoting section arranged on an end of a clutching section and a spring which pulls the clutching section into interaction with the hole.

2. A collapsible rack according to claim 1, wherein each distance bar includes a bar section and two end sections, wherein the bar section slides into a bar hole on each of the end sections, and wherein the end sections further include a locking hole and a lock screw arranged perpendicular to the bar section.

3. A collapsible rack according to claim 1, wherein the clutching sections are tapered and the hole is tapered to match the clutching section, the taper being larger than 1° as seen from an insertion axis of the hole.

4. A collapsible rack according to claim 1, wherein the first and second panels each include first and second channels that run between the third and fourth edges and parallel to the first and second edges and end with the holes on the third and fourth edges, the first channel being arranged adjacent to the first edge and the second channel being arranged adjacent to the second edge.

5. A collapsible rack according to claim 4, wherein the second channel is arranged parallel to the fourth edge.

6. A collapsible rack according to claim 5, wherein the second channel ends with a guiding hole.

7. A collapsible rack according to claim 6, wherein the guiding hole is configured to receive couplers of secondary distance bars.

8. A collapsible rack according to claim 7, wherein the couplers include a spring configured to pull the couplers into interaction with the guiding hole.

9. A collapsible rack according to claim 5, wherein each distance bar includes a bar section and two end sections, wherein the bar section slides into a bar hole on each of the end sections.

10. A collapsible rack according to claim 9, wherein the end sections include a locking hole and a lock screw arranged perpendicular to the bar section.

11. A collapsible rack according to claim 7, wherein the couplers are tapered and the guiding hole is tapered to match the couplers.

12. A collapsible rack according to claim 11, wherein the taper is larger than 1° as seen from an insertion axis of the hole.

13. A collapsible rack according to claim 1, wherein the rack is manufactured of a polymeric material selected from the group consisting of: polyethylene, polypropylene, polybutene, polyvinyl-chloride, polyalkylene-therephtalate, acrylonitrile-butadiene-styrene-copolymer, polyamide, polycarbonate, polyether-sulphone and a combination thereof, through injection molding, vacuum molding, blow molding, extrusion, or combinations thereof.

14. A collapsible rack according to claim 13, wherein the polymeric material further contains a filler selected from the group consisting of: carbon black, fiber glass, carbon fiber, aramide fiber, steel fiber, and combinations thereof.

15. A collapsible rack according to claim 2, wherein the bar section is manufactured of a metal selected from the group consisting of: aluminum and magnesium through a method selected from the group consisting of extrusion and injection molding.

16. A collapsible rack according to claim 7, wherein the distance bar and the secondary distance bars are manufactured of a metal selected from the group consisting of: aluminum and magnesium through injection molding.

17. A collapsible rack according to claim 1, wherein the non-circular shaped hole is so shaped that the clutching section is prevented from rotating around a longitudinal axis thereof in a clutched position.

18. A collapsible rack according to claim 16, wherein the non-circular shaped hole includes a hole wall surface with a non-constant radius.

19. A collapsible rack according to claim 17, wherein the non-circular shaped hole includes a shape selected from the group consisting of: triangular, oblong, quadratic, rectangular, pentagonal, hexagonal, star-shaped, provided with splines, provided with ribs, provided with satellites, and a combination thereof.

* * * * *